US005261196A

United States Patent [19]

Buckenmaier et al.

[11] Patent Number: 5,261,196

[45] Date of Patent: Nov. 16, 1993

[54] ROOF WATER DISPERSAL SYSTEM

[75] Inventors: Erwine T. Buckenmaier, Westport; Richard J. Urban, Weston, both of Conn.

[73] Assignee: Savetime Corporation, Bridgeport, Conn.

[21] Appl. No.: 822,548

[22] Filed: Jan. 17, 1992

Related U.S. Application Data

[63] Continuation-in-part of Ser. No. 780,869, Oct. 18, 1991.

[51] Int. Cl.[5] ..... E04B 7/00

[52] U.S. Cl. ..... 52/94; 52/12; 52/97

[58] Field of Search ..... 52/11, 24–26, 52/94, 97, 12; 248/48.1, 48.2, 68.1

[56] References Cited

U.S. PATENT DOCUMENTS

| | | | |
|---|---|---|---|
| 2,708,775 | 5/1955 | Maas | 52/78 |
| 3,662,503 | 5/1972 | Praisler | 52/97 |
| 3,939,616 | 2/1976 | Schapker | 52/94 |
| 4,068,424 | 1/1978 | Madfis | 52/97 X |
| 4,646,488 | 3/1987 | Burns | 52/94 |

*Primary Examiner*—Carl D. Friedman
*Assistant Examiner*—Beth A. Aubrey
*Attorney, Agent, or Firm*—Mark P. Stone

[57] ABSTRACT

A roof water dispersal system includes a plurality of longitudinally extending dispersal elements mounted near the edge of a roof structure for receiving and dispersing streams of roof run-off water. The elements are spaced apart from each other and assembled into a unit mounted to receive the streams of run-off roof water. The individual elements within the assembly can vary in shape, thickness, or material to provide an optimum balance between dispersal efficiency and strength of the overall assembly. A weir is mountable near the edge of the roof and aligned with cross members of the rain dispersal assembly to divert the roof run-off water streams from impacting on regions of the assembly at which the dispersal elements intersect with cross members to prevent undesirable deflection or collection of run-off water at these regions. The systems of the present invention are designed to provide optimum dispersion characteristics at regions of the assembly intended to receive the major portion of roof run-off water, to divert streams of water away from regions of the assembly having less than optimum dispersal characteristics, or to modify components of the system such as supporting brackets and cross members to minimize the adverse effect of such components on the dispersion characteristic of the system.

10 Claims, 6 Drawing Sheets

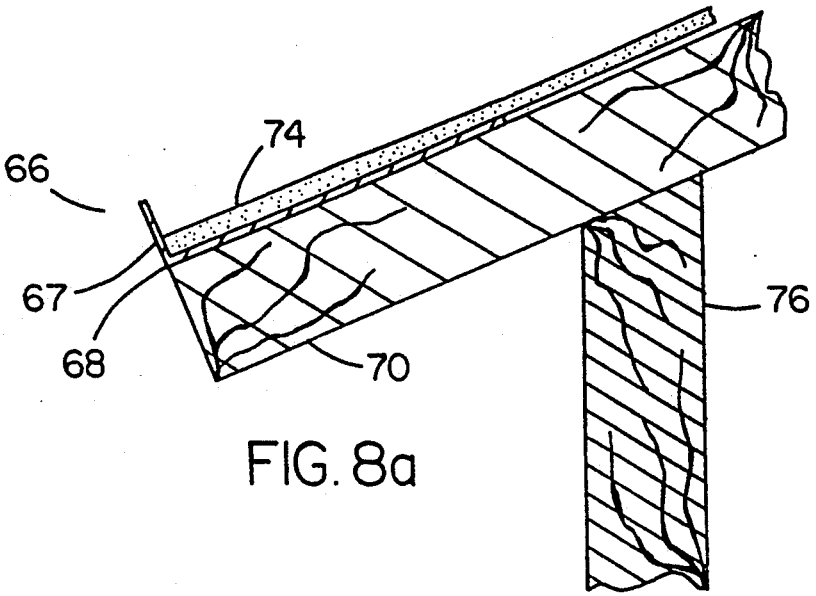
FIG. 8a
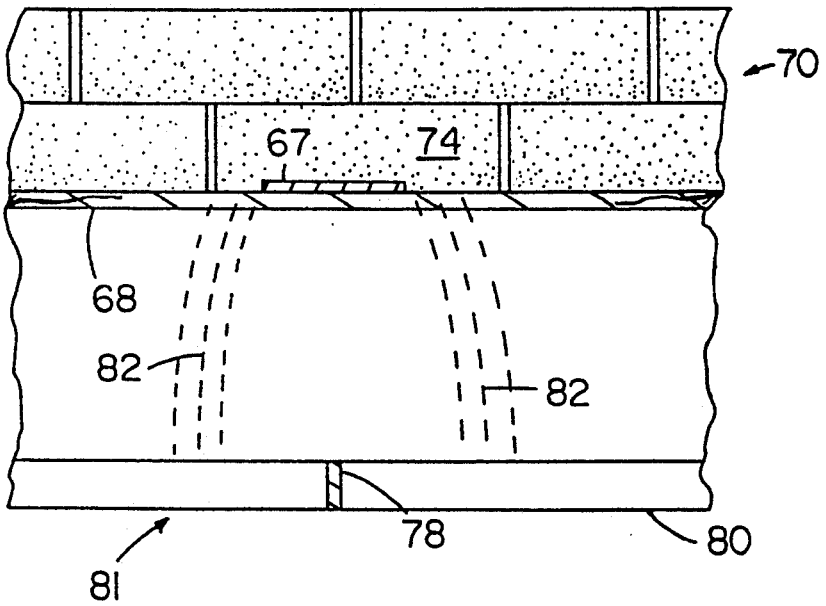
FIG. 8b
FIG. 8c
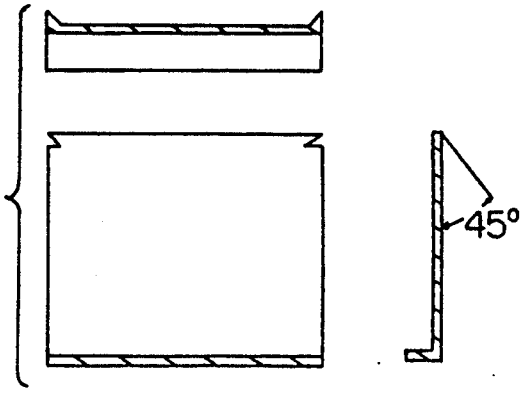

ROOF WATER DISPERSAL SYSTEM

This is a continuation-in-part application of Ser. No. 07/780,869, filed on Oct. 18, 1991 and entitled "Roof Water Dispersal System.

BACKGROUND OF THE INVENTION

The present invention is generally directed to roof water dispersal systems such as those disclosed in U.S. Pat. No. 3,939,616 entitled "Rain Water Run-Off Disperser" issued on Feb. 24, 1976 to Richard L. Schapker, and U.S. Pat. No. 4,646,488 entitled "Rain Disperser System" issued to Lawrence C. Burns on Mar. 3, 1987. The disclosures of the aforementioned patents are expressly incorporated herein by reference.

A roof water dispersal system of the general type to which the present invention is directed includes a plurality of longitudinal dispersal elements or slats which are oriented to extend in a direction parallel to the drip edge of a roof structure. The assembly includes one or more cross members which intersect the slats in a transverse direction for assembling the slats into a unit and for maintaining a predetermined angular orientation and spacing between individual slats. The assembled unit is mounted to either the roof structure itself or a vertical wall of a building structure such that the plurality of parallel slats are positioned relative to the drip edge of the roof to receive, to deflect, and to disperse streams of run-off water flowing downwardly from the roof.

The roof water disperser systems of the aforementioned type are intended to replace conventional rain gutters. As more fully discussed in the above referenced prior art, rain gutters are expensive to install, require continuous maintenance to remove leaves and other debris which accumulate in the channels, and divert roof run-off water into relatively large streams which impact against the same area or areas of the underlying terrain with a damaging and corrosive effect. On the contrary, rain dispersal systems employing parallel slats may be installed on either new or pre-existing structures, and require virtually no maintenance subsequent to installation. Moreover, run-off roof water is dispersed by the multiple-slat assembly over a wide range of terrain extending along the entire roof edge, thereby avoiding any damaging and corrosive effect on the underlying terrain which would otherwise result from the impact of high velocity streams of unimpeded run-off water.

Notwithstanding the benefits and the advantages of the roof-water dispersal systems disclosed by the above prior art over conventional rain gutters, there still exist areas in which the overall efficiency of a "slat type" dispersal system can be improved. The known dispersal systems did not address slat thickness as a performance variable. Now it has been discovered that thinner slats provide a better dispersal effect, and a roof water dispersal system may be assembled to employ such thinner slats in selected positions of the assembly where optimum dispersion characteristics are most desirable.

The known roof water dispersal systems comprise either flat slats or bent slats. However, a rain disperser assembly including at least some partially or fully curved slats will improve the dispersion characteristics and efficiency of the overall assembly.

The known dispersal systems employ identical slats of uniform thickness formed from aluminum. Although U.S. Pat. No. 4,646,488 suggests the possibility of substituting plastic, this prior art clearly does not represent or suggest the advantages obtained from the use of a plastic material of the present invention as more fully described herein.

Transverse cross members of the known dispersal systems, which are necessary to adequately maintain a predetermined spacing between slats and to maintain each slat at a predetermined angle of orientation relative to the horizontal, adversely affect the dispersion characteristic of the assembly at regions of intersection with the longitudinal slats. Dispersion efficiency can be improved by both redesigning the cross-members (e.g., spacer elements, brackets), and/or providing means for diverting the flow of roof water to avoid impact on the assembly at the regions in which the cross-members intersect the longitudinally extending slats.

It is the object of the present invention to provide an improved roof run-off water dispersal system of the type employing a plurality of longitudinally extending dispersal elements oriented parallel to the drip edge of the roof. The improvements to the dispersal characteristics and overall dispersion efficiency of the system result from, among other things, an assembly comprising one or more slats having a thickness less than other slats in the assembly; an assembly including one or more slats having a configuration different from other slats in the assembly; an assembly comprising slats formed from different materials; an assembly combining slats of different thickness, shape, material, and/or variable cross-section/thickness; an assembly including a weir for diverting run-off water from regions in which cross members intersect slats; and an assembly in which the cross-members are designed and/or oriented to reduce their negative effect on the dispersion characteristic and efficiency of the overall dispersal system. Other objects and improvements of roof water disperser systems in accordance with the present invention will become apparent from the following discussion.

SUMMARY OF THE INVENTION

A roof run-off water dispersal system includes a plurality of longitudinally extending dispersal elements oriented parallel to a drip edge of a roof structure, and which are mounted relative to the roof structure to receive streams of run-off water therefrom. The dispersal elements are maintained in a predetermined spacing relative to one another, and at a predetermined angle of inclination relative to the horizontal, by one or more cross members intersecting the slats in a substantially transverse direction. The assembly comprising the dispersal elements and cross members is mounted from the roof or other portions of a building structure so that the dispersal elements are positioned relative to the drip edge of the roof for receiving run-off water flowing from the roof and dispersing the water over a wide lateral range of terrain forward of the assembly along the entire length of the assembly.

The longitudinal elements comprising the assembly are preferably specially configured to optimize the performance of the overall assembly. For example, curved or partially curved elements with or without bends can be positioned in the central region of the assembly to receive the major flow of run-off water from the roof to optimize the dispersion characteristics of the assembly. Straight or bent slats may be positioned inwardly and outwardly of the centrally orientated louvers to enhance the rigidity or strength of the roof water disperser assembly.

The assembly can further include dispersal elements of different thicknesses. Preferably, the elements positioned in the center of the assembly will be of lesser thickness than the elements positioned on or towards the inner and outer sides of the assembly. The elements of lesser thickness provide better dispersion characteristics than the thicker elements, and therefore are located in a position in the assembly to receive the major portion of roof run-off water. The thicker elements positioned inwardly and outwardly relative to the thinner elements enhance the strength of the assembled system. The thinner, centrally disposed elements, may also be of a curved or partially curved configuration, as discussed above, to further enhance the dispersion characteristics of the overall assembly. One or more of the dispersal elements of the system may be formed in variable cross-section/thickness preferably having its greater thickness defined at the center portion of the element and its thinner portions defined proximate to one or both of the free edges of the element.

The assembly may also comprise dispersal elements formed from different materials, as for example, aluminum and lightweight plastic, such that the centrally disposed elements may be formed from plastic, while the inner and outer edge elements of the assembly may be metallic to increase the rigidity and strength of the overall assembly.

An improved rain dispersal system may include one or more of the aforementioned features of the invention. Different combinations of dispersal elements having different and/or variable thicknesses, configurations, or formed from different materials are effectively employed in an overall assembly to provide an optimized balance between roof water dispersion characteristics and the required strength or rigidity to maintain the assembly in its predetermined operational orientation relative to a roof structure.

The present invention further improves the interrelationship between the longitudinally extending dispersal elements and the transverse cross members necessary to maintain the system in its assembled operational state. The transverse cross members include both brackets for mounting the assembly relative to a roof edge, and spacer elements necessary to maintain the longitudinal elements in a predetermined relative spacing and at a predetermined relative angular orientation. The present invention reduces the undesirable negative dispersion effect of roof water impacting on the assembly at regions where the elements and cross members intersect by designing the cross member components to enhance the dispersion of impacting water; by providing means for diverting the flow of run-off water from the roof to avoid any substantial quantity of run-off water from impacting against areas of intersection of elements and cross members; and by combining a bracket and spacer element in a single structure to minimize the number of regions of intersection between cross members and slats.

The various embodiments of the present invention, as are more fully discussed below, provide an overall rain dispersal system which optimizes the efficiency of dispersion of roof run-off water based upon one or more structural modifications, arrangement of structure, and principals of operation resulting therefrom. Combinations of the different aspects and features of the present invention are employed to still further optimize the dispersion efficiency of the overall roof water dispersal system.

In addition to other advantages, rain dispersal systems in accordance with the present invention minimize erosion of the terrain below by increasing the lateral range of perpendicular forward projection of roof run-off water away from a building structure, distributing dispersed water over a larger surface area, and substantially reducing the quantity of water falling onto the terrain immediately below the drip edge of the roof. In addition, the improved dispersal system significantly reduces rearward perpendicular projection of dispersed roof run-off water to minimize the undesirable impact of dispersed water against the building structure itself.

BRIEF DESCRIPTION OF THE DRAWINGS

FIG. 8(*a*) illustrates a sectional view of a roof structure having a water diversion element mounted thereon, FIG. 8(*b*) illustrates a front view of FIG. 8(*a*) and further illustrates the diversion of roof run-off water onto a rain dispersal system mounted forward of the roof edge, and FIG. 8(*c*) illustrates details of the water diversion element;

DESCRIPTION OF THE BEST MODES FOR CARRYING OUT THE INVENTION

Figure 1:
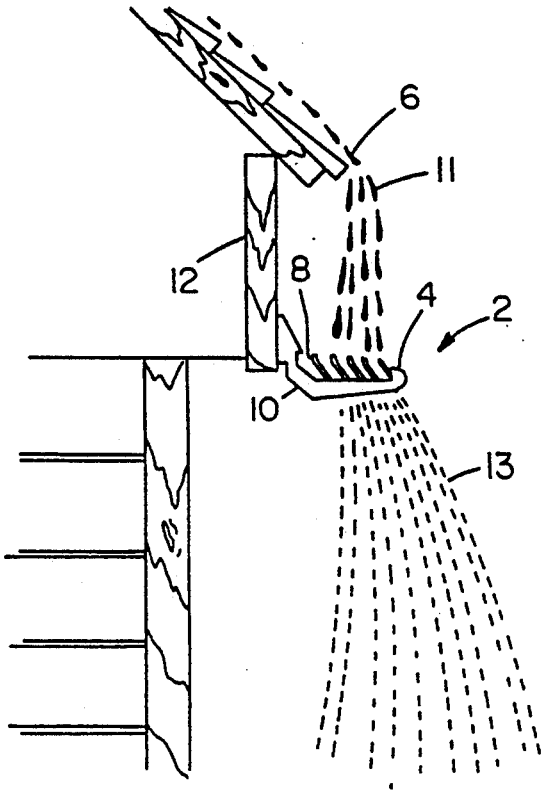
FIG. 1 PRIOR ART
FIG. 1 of the drawings illustrates a perspective view of a prior art rain dispersal system mounted to the fascia board of a building structure and positioned to receive run-off water from the edge of a roof.

FIG. 1 of the drawing illustrates a known rain dispersal system of the general type disclosed by the prior art. The roof water dispersal system is shown generally by the reference numeral 2, and includes a plurality of longitudinally extending slats 4 which are oriented parallel to the drip edge of a roof 6. The slats are of the same configuration and thickness. Each of the slats is substantially straight or flat and includes an upper bent portion, similar to the slats illustrated in U.S. Pat. No. 4,646,488. A transverse spacer element 8 intersects the slats in a substantially transverse orientation, and is provided to maintain the slats in a predetermined spaced relationship relative to one another, and to maintain each slat in a predetermined inclined angular orientation relative to the horizontal. A bracket 10 is provided to mount the roof water disperser 2 comprising the slats 4 and the spacer elements 8 to fascia board 12 of a building structure. When mounted, the disperser 2 is positioned forwardly and below the drip edge of the roof 6 to receive run-off water 11 from the roof and disperse it away from the building structure as designated by reference numeral 13. Attention is invited to U.S. Pat. Nos. 3,939,616 and 4,646,488 for further details concerning the general nature of a disperser system such as that illustrated by FIG. 1. The means for assembling the slats of the prior art onto the transverse spacer element cross member as described in the aforementioned prior art references may also be employed in the improved roof water dispersal system of the present invention, to be described below.

Figure 2A:
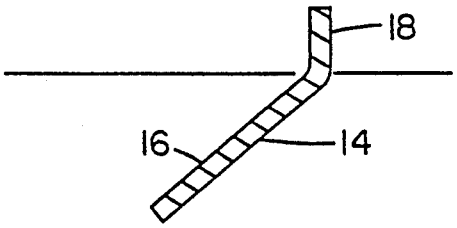
FIG. 2a PRIOR ART
FIG. 2(*a*) illustrates a sectional view of a slat employed in prior art roof dispersal systems, and FIG. 2(*b*) illustrates a sectional view of a curved louver in accordance with one feature of the present invention.
Figure 2B:
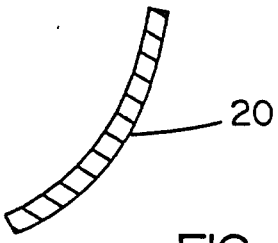

FIGS. 2*a* and 2*b* of the drawing compare a conventional slat 14 and a curved inclined louver 20, in accordance with one feature of the present invention. The slat 14 of FIG. 2*a* includes a longer inclined straight portion 16 which merges into an angled, substantially vertical shorter portion 18. The curved, inclined louver 20, as shown in FIG. 2*b* is arcuate in cross section. Curved louvers provide a wider lateral range of dispersement and projection of run-off roof water away from a building structure and less dispersement of the run-off water towards the building structure, as compared with straight or bent flat slats used in the known rain dispersal systems.

Figure 3A:
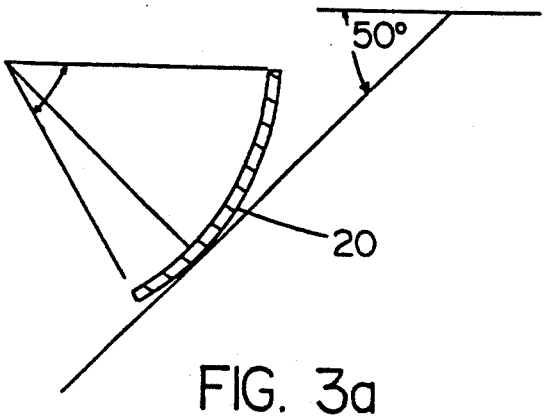
FIG. 3(*a*) illustrates a sectional view of a fully curved louver employed in a rain dispersal system of the present invention, and FIG. 3(*b*) illustrates a sectional view of a partially curved louver employed in the rain dispersal system of the present invention.
Figure 3B:
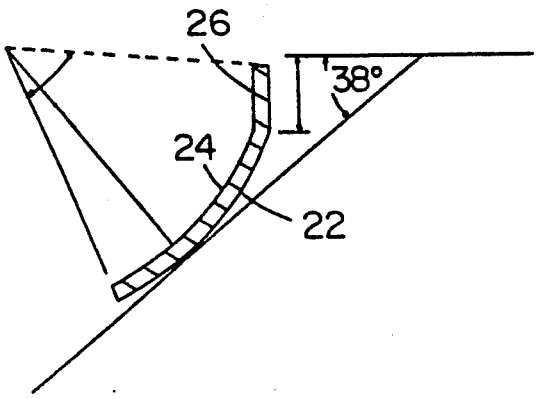

FIG. 3*a* illustrates the arcuate louver shown in FIG. 2*a*, and provides specific dimensions therefor. Preferably, the arcuate louver 20 of FIG. 3*a* is radial (having a radius of 0.75") and defines an arc of one radian, having a tangent at an angle of 50° from the horizontal. The louver 22 of FIG. 3*b* illustrates a slight modification in which the upper louver segment 26 is straight and defines a bend extending from an arcuate lower louver segment 26. The lower arcuate is radial, preferably having a radius of 0.75". The arcuate segment 24 improves the dispersion characteristic of the louver 22, as discussed above, while the bent or straight louver segment 26 increases the rigidity and strength of the overall louver.

Figure 4A:
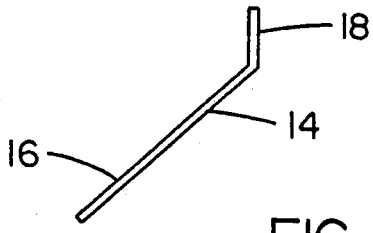
FIG. 4(*a*) illustrates a sectional view of a thin slat, and FIG. 4(*b*) illustrates a sectional view of a thin curved louver.
Figure 4B:
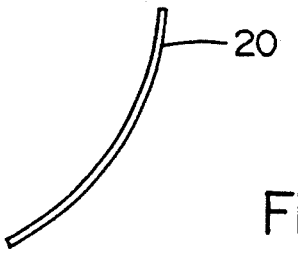

FIGS. 4*a* and 4*b* of the drawing illustrate both the flat inclined slat 14 and the curved inclined louver 20, as previously shown in FIGS. 2*a* and 2*b*, in which all segments of the respective slats and louvers are less than 32 mils in thickness. The use of relatively thin slats or louvers, preferably in the order of about 25 mils, improves the dispersion characteristic of the slats and louvers by increasing the lateral range of forward projection of roof run-off water away from a building structure and by decreasing dispersion of the run-off water towards the building structure. The improved dispersion characteristic resulting from the use of relatively thin slats is also realized from reducing the thickness of partially curved louvers 22 such as those illustrated by FIG. 3*b*. Optimum enhancement of the dispersion characteristic results from the use of thin, curved louvers since both the reduced thickness of the louver and the curved configuration thereof each independently contribute to the improved dispersion characteristic.

Figure 5B:
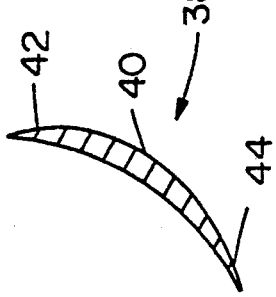
FIG. 5(*a*) illustrates a sectional view of the slat shown in FIG. 4(*a*) which has been tapered at its ends, and FIG. 5(*b*) illustrates a sectional view of the curved louver shown in FIG. 4(*b*) which has been tapered at its ends.
Figure 5A:
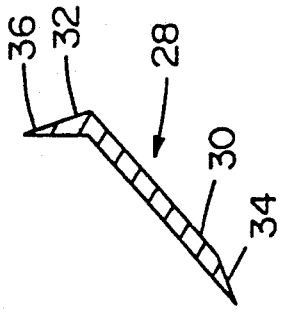

FIGS. 5*a* and 5*b* of the drawing illustrate further modifications of the cross sectional configurations of slats and louvers in accordance with the present invention in which the thickness of each individual element varies. The slat 28 of FIG. 5*a* has a flat, inclined cross sectional configuration including a longer downwardly inclined straight segment 30, and a shorter upwardly extending segment 32 oriented at an angle relative to the lower portion and extending substantially vertically relative to the horizontal. Both the free edge 34 of the longer segment 30 and the free edge 36 of the shorter segment 32, are each tapered and reduced in cross section and terminate in an essentially sharp edge. The portions of the slat 28 intermediate between the ends 34 and 36 are substantially uniform in thickness. The arcuate louver 38 of FIG. 5*b* is crescent shaped, having its maximum thickness at its center region 40 and tapering to a reduced thickness in a direction towards both of its free edges 42 and 44. The tapered cross sectional configurations of the slat 28 and the louver 38 each improve the dispersion characteristics of a roof water dispersal system of the type illustrated by FIG. 1.

Figure 10A:
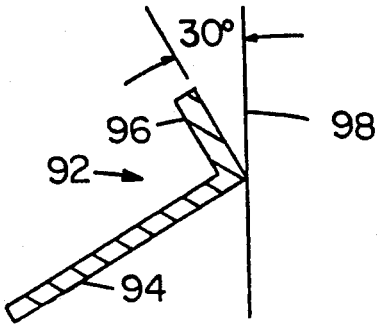
FIG. 10(*a*) illustrates a sectional view of a flat slat having a bent portion oriented at an angle relative to the vertical, and FIG. 10(*b*) illustrates a sectional view of a curved louver having a bent portion oriented at an angle relative to the vertical.
Figure 10B:
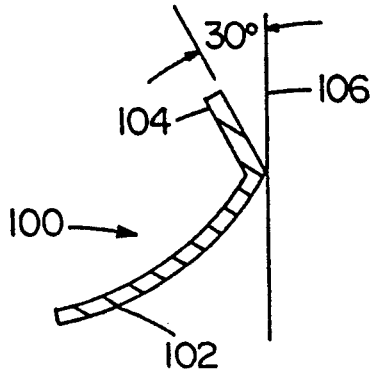

FIGS. 10(*a*) and 10(*b*) illustrate additional modifications of the cross sectional configurations of slats and louvers in accordance with the present invention. Referring first to FIG. 10(*a*), a slat 92 includes a longer flat or straight portion 94 and a shorter bent portion 96 extending from one end thereof. Unlike the slats illustrated in the aforementioned U.S. Pat. No. 4,646,488 (see, for example, FIG. 2 thereof), slat 92 is oriented relative to a vertical line 98 (which can be the fascia board 12 of a roof—see FIG. 1) at an angle other than zero degrees. Stated in other words, the bend 96 does not have a vertical orientation when the slat 92 is assembled within a roof water disperser assembly in accordance with the present invention. Preferably, the slat 92 will be mounted in an assembly such that the bent portion 96 of the slat 92 will be angularly oriented relative to the vertical 98 at angles which are greater than zero degrees and less than or equal to 70 degrees in directions facing both away from and towards the roof structure or fascia board. In the preferred embodiment of the invention, the slat 92 is assembled in a roof water disperser system such that the bent portion 96 is oriented relative to the vertical 98 at an angle of substantially 30 degrees and faces away from the roof structure or fascia board.

FIG. 10(*b*) illustrates a cross sectional view of a curved louver 100 comprising a longer curved portion 102 and a straight bent portion 104 extending from one end thereof. A vertical line 106, similar to the vertical line 98 of FIG. 10(*a*) represents the plane perpendicular to the drip edge of a roof structure (or parallel to the fascia board 12—see FIG. 1) to which a roof water disperser assembly is mounted. As discussed with respect to FIG. 10(*a*), the slat 100 is assembled in a roof water disperser system such that the shorter bent portion 104 is at an angular orientation relative to the vertical 106 which is greater than zero degrees and less than or equal to 70 degrees in directions in which portion 104 both faces away from and towards the vertical 106. As also discussed with respect to FIG. 10(*a*), in the preferred embodiment, the slat 100 is assembled in a roof water disperser system such that the bent portion 104 is oriented at an angle of substantially 30 degrees relative to the vertical 106 and faces in a direction away from the roof structure or fascia board.

Slat 92 of FIG. 10(*a*), and curved louver 100 of FIG. 10(*b*) have been found to advantageously improve the dispersion performance of a roof water dispersal system by both increasing the forward projection (i.e., away from the roof structure) of roof run-off water, and by decreasing the backward projection (i.e., towards the roof structure) of roof run-off water. It is believed that the improved performance of roof water dispersal assemblies employing slats and louvers in accordance with FIGS. 10(*a*) and 10(*b*) results from the angular orientation of the bent portions 96 and 104, respectively, relative to the vertical surface of the structure to which the assembly is mounted (e.g., vertical lines 98 and 106, respectively).

The slats and louvers which have been discussed above may be formed from any suitable material. The slats of known roof water dispersal systems conventionally are made from lightweight, durable metals, such as aluminum. However, aluminum slats, to some extent, have been found to promote undesirable flow of roof water in a longitudinal direction along the slat. This effect is believed to result from microscopic channels and grooves on the surface of aluminum slats which are likely caused during the manufacture of the slats. The slats and louvers employed in the present invention may be formed from a lightweight, durable non-metal material such as plastic which does not promote any undesirable longitudinal flow of water. It is believed that molded plastic slats do not include any significant grooves or channels promoting longitudinal flow. Moreover, the specific cross sectional configurations of louvers and slats, particularly those having tapered edges and variable thickness as illustrated in FIG. 5, may be more precisely defined by a plastic material formed by conventional molding processes, as compared to slats formed from a metal such as aluminum.

Figure 6:
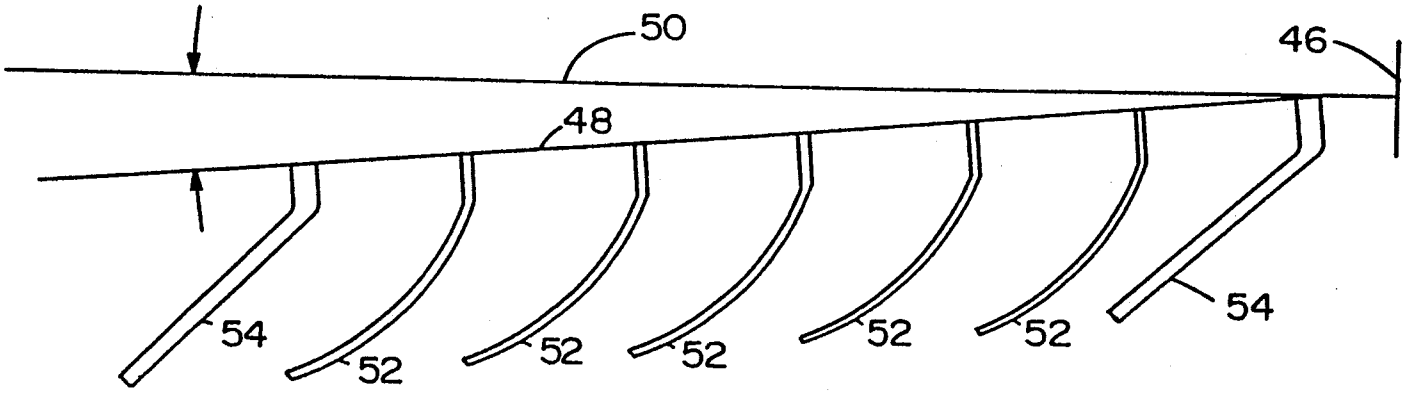
FIG. 6 schematically illustrates one arrangement of louvers and slats of a rain dispersal system assembled in accordance with one aspect of the present invention.

FIG. 6 of the drawing illustrates a schematic view of a rain disperser assembly in accordance with the present invention. The assembly is mounted to a building or roof structure designated generally by reference numeral 46 and is oriented along a plane 48 having a downward slope relative to the horizontal 50 in a direction forwardly of the building or roof structure 46. A plurality of curved louvers with bends, such as those disclosed in FIG. 3*b* of the drawing, are located centrally within the assembly. Two flat inclined slats with bends, such as those disclosed in FIG. 2*a* of the drawing, form the forward and rear longitudinal members of the rain disperser assembly defining the forward and rear lateral edges thereof. The assembly is mounted so that both the central louvers 52 and the end slats 54 extend longitudinally and substantially parallel relative to the drip edge of a roof, and the relative positions and angular orientations of the louvers and slats are maintained by substantially transversely oriented cross members comprising spacer elements (not shown in FIG. 6) such as those disclosed in the aforementioned prior art. The assembled slats, louvers and cross members may be mounted in the desired position relative to the drip edge of the roof by suitable bracket means (not shown in FIG. 6).

In the arrangement of the roof water dispersal assembly illustrated by FIG. 6, the flat slats 54 are located at the forward and rearward lateral edges of the assembly to enhance the rigidity and strength of the assembled unit and to reduce undesirable vertical deflections or deformations of the assembly. Although the roof water dispersion characteristics of the flat inclined slats 54 are less optimum than that of the arcuate louvers 52, the flat slats are located at the lateral edges of the assembly so that only a relatively small or minimal portion of run-off roof water will impact against these slats when the assembled unit is mounted relative to a building or roof structure in its operational position. The curved louvers 52, which have a dispersion characteristic superior to that of the slats 54, are positioned centrally within the assembled unit to receive and disperse the significantly major portion of roof run-off water impacting against the assembly. Accordingly, the dispersal assembly schematically illustrated by FIG. 6 provides a desirable balance between optimum water dispersal characteristic and strength and rigidity of the assembled unit by positioning the stronger longitudinal components having lesser dispersal characteristics at locations in the assembly where increased strength is more important than increased water dispersal characteristic, and by positioning the less rigid but higher dispersal longitudinal components at locations in the assembly where increased dispersion characteristic is more important than increased strength and rigidity. Similarly, the assembly of FIG. 6 can include curved louvers without a bend, as illustrated in FIG. 2*b*, in lieu of the bent/curved louvers 52 of the assembly illustrated by FIG. 6. Likewise, slats 92 as illustrated in FIG. 10(*a*), curved louvers 100 as illustrated by FIG. 10(*b*), or a combination of both slats 92 and louvers 100, can be substituted for all or some of the louvers 52 and slats 54 illustrated by FIG. 6.

In a similar manner, the flat inclined edge slats 54 may be replaced with the feathered or tapered slats illustrated by FIG. 5*a* of the drawing; the curved central louvers 52 may be replaced by the feathered or tapered curved louver illustrated by FIG. 5*b*; or both the edge slats 54 and the central louvers 52 may be replaced, respectively by the feathered slats and louvers illustrated by FIG. 5. The tapered inclined edge slats will still primarily provide strength and rigidity to the assembled unit, but the dispersal characteristics of the edge slats will be improved as a result of the feathered configuration; and the centrally disposed louvers will still provide the desirable improved dispersion characteristic, but the strength of the central louvers will be slightly improved as a result of the variable thickness, feathered configuration.

The modifications to the rain dispersal assembly of FIG. 6 discussed to now have been directed to combinations of different configurations of edge slats and central louvers to optimize a balance between enhanced dispersal characteristic and the strength of the overall assembled unit. It is also within the scope of the present invention to provide an assembled rain dispersal unit in which all longitudinally extending dispersal components are of the same or different configuration, but vary in relative thickness. One such modified embodiment of the invention encompasses the assembly illustrated by FIG. 6 and the modifications thereto discussed above, further modified to include central longitudinal components (such as the curved louvers 52) which have a cross sectional thickness less than the cross sectional thickness of one or both of the longitudinally extending lateral edge members (such as the inclined slats 54). Preferably, the thinner longitudinally extending components will be of the thickness of in the order of 20–25 mils, while the longitudinally extending lateral edge members will be of a thickness in the range between 30–40 mils. As discussed above, thinner louvers or slats provide better water dispersal characteristic than thicker louvers or slats, while the thicker elements provide better rigidity and strength than the thinner elements. Accordingly, the thinner louvers or slats are centrally disposed within the assembly to receive the major portion of the roof run-off water to improve the dispersal characteristic of the overall assembly, while the thicker louvers and slats are located at the edges of the assembly to enhance the overal rigidity and strength thereof.

It is not necessary that the thickness of each of the centrally disposed louvers or slats be the same as the thickness of other louvers or slats in the assembly. For example, the thickness of the central elements may sequentially vary in a direction from one or both lateral edges of the assembly towards the lateral center of the assembly. Preferably, the two louvers 52 (of FIG. 6) adjacent to the edge slats 54 will be thicker than the next two respective innermost louvers 52, which themselves will be thicker than the central louver 52. In this manner, the thinner elements having better dispersal characteristics are disposed towards the lateral center of the assembly, while the thicker louvers having better strength characteristics are disposed towards the inner and outer lateral edges of the asembled unit. It is evident that the assembly may be arranged to concentrate the thinner louvers at any desired location thereon. The edge slats 54 (of FIG. 6) may be of the same or different thickness relative to each other.

The modifications to the thickness of the longitudinally extending disperser components, as discussed above, are equally applicable to assemblies in which all longitudinally extending members, including the inner and outer lateral edge members, are of the same cross sectional geometrical configurations. For example, both the central louvers 52 and the edge slats 54 all can be formed in the same configuration (such as any of the cross sectional shapes illustrated by FIGS. 2–5, including the flat inclined slat configuration), and the thicknesses of these disperser elements are selected to vary to optimize the overall dispersion characteristic—strength combination of the assembly. Preferably, the thickness of the dispersal elements will vary as discussed above—a progressive decrease in thickness from the opposed lateral outer edges of the assembled unit towards the lateral center thereof—so as to orient the higher dispersion thinner elements towards the center of the assembled dispersal unit where the majority of the roof run-off water will impact the assembly.

In addition to varying the cross-sectional configuration and/or the thickness of the longitudinally extending dispersal elements of a roof water disperser system in accordance with the present invention, it is also within the scope of the invention to vary the material from which the elements are formed. For example, one or more of the intermediate centrally disposed louvers 52 of the assembly shown by FIG. 6 may be formed from a plastic material to enhance the dispersion characteristic of the assembly (for the reasons previously discussed), while the edge slats 54 may be formed from a lightweight metal such as aluminum to enhance the rigidity and strength of the overall assembly. In the alternative, some, but not all, of the centrally disposed dispersal elements may be formed from a material which is different from other centrally disposed louvers and the edge members. As a further alternative, the two opposed lateral edge members may be formed from plastic, while one or more of the intermediate louvers is formed from metal. The rain dispersal systems of the present invention including variations in the materials forming the longitudinal elements, may also be combined with the other aspects of the invention discussed above including variations in the thickness and/or cross sectional configurations of the longitudinally extending dispersal elements in which some or all of the dispersal elements are formed from a plastic or non-metallic material.

It is apparent from the embodiments of the invention discussed to now that the improved rain dispersal systems of the present invention optimize the balance between improved dispersal characteristics and strength and rigidity of the assembled unit by varying one or more of the following parameters: 1) the cross sectional configuration and thickness of the longitudinally extending disperser elements; 2) the relative thicknesses of the longitudinally extending disperser elements; and 3) the materials from which the longitudinally extending disperser elements are formed. The presently preferred embodiment of the invention employs the slats and louvers configured as shown in FIG. 6 of the drawing in which all of the disperser elements 52 and 54 are configured in cross section as shown in either FIGS. 10(*a*) or 10(*b*) and which sequentially decrease in thickness from the opposed lateral edges of the assembly towards the lateral center of the assembly.

Figure 7:
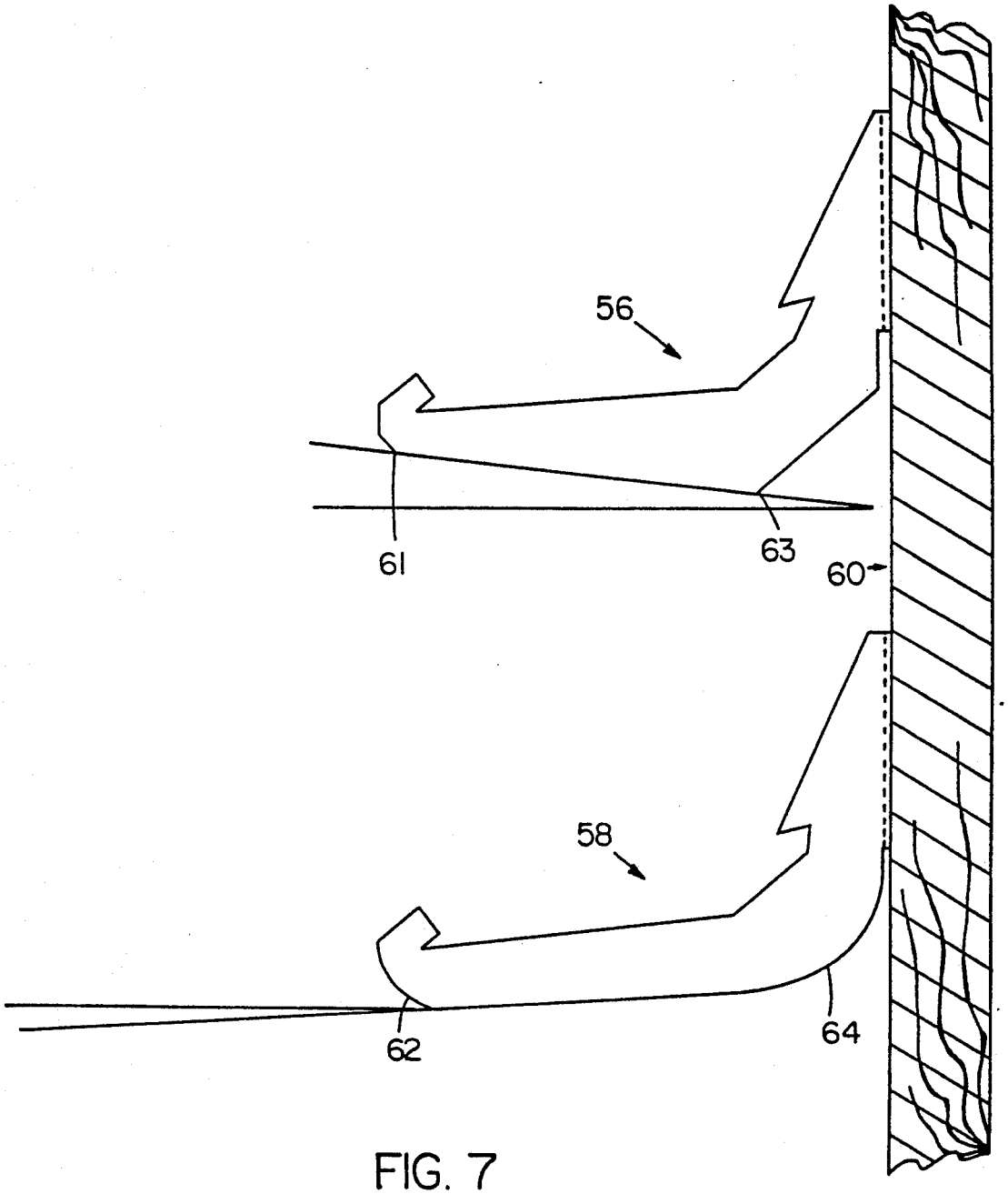
FIG. 7 illustrates a side elevational view of a standard bracket and an improved bracket in accordance with the present invention mounted to a vertical wall of a building structure.

FIG. 7 of the drawing compares a standard bracket 56 used to mount rain dispersal assemblies of the general type to which the present invention is directed, to an improved bracket 58 in accordance with a further aspect of the present invention. Both brackets 56 and 58 are shown mounted to vertically oriented fascia board 60 of a building structure so that a roof water dispersal assembly carried by the bracket will be positioned relative to the drip edge of a roof to receive the flow of run-off water therefrom. The standard bracket 56 is oriented to slope upwardly from the horizontal in a direction away from the fascia board 60. The bracket 56 also defines two sharp corners designated by the reference numerals 61 and 63.

In contrast, the improved bracket 58 is mounted relative to the fascia board 60 so that the bracket slopes downwardly relative to the horizontal in a direction outwardly from the vertical wall 60. Preferably, the angular slope is in the order of five degrees. The bracket 58 further defines both front and rear rounded corners, designated, respectively, by the reference numerals 62 and 64.

Brackets for mounting longitudinally extending dispersal elements in roof water dispersal systems of the present type constitute cross members which intersect the longitudinally extending disperser elements in a substantially perpendicular orientation. These cross members have an adverse effect on the dispersion characteristic of the disperser assembly as a result of interference resulting from roof run-off water impacting against the exposed top surfaces of the cross members, causing random and uncontrolled dispersion of the water including the undesired projection of water back towards the building structure or directly downwardly from the dispersal assembly. Moreover, the backward slope of a standard bracket 56, together with the front and rear lower sharp corners 61 and 62, tends to cause roof run-off water to collect on the bracket structure and drip directly downwardly therefrom. Both the forward slope and the rounded corners of the improved bracket 58 tend to reduce the aforementioned undesired effects of the standard bracket 56.

FIG. 8 of the drawing illustrates a further aspect of the present invention for optimizing the overall efficiency of the improved roof run-off water dispersal system by reducing the aforementioned adverse effect of roof run-off water impacting against transverse cross members of a rain dispersal system. A weir or water diversion element 66 is mounted proximate to the drip edge 68 of a roof 70 by a rearwardly extending member 72 disposed between the upper surface of the roof and shingles 74. Vertically oriented fascia board 76 of a building structure supports the downwardly inclined roof. The weir 66 is mounted to the roof in substantial alignment with a cross member 78 of a rain disperser system 81 such that water 82 flowing from the drip edge of the roof is diverted by the forward elevated portion 67 of the weir around the cross member 78, and impacts only against longitudinally extending members 80 of the roof water disperser system mounted therebelow. Preferably, the weir 66 is ⅜" high, 3" wide, and the rear arm 72 extends backwardly 2½". The weir is affixed to the roof by a tab 73 extending downwardly from the rear end of the bottom surface of the arm 72 at an angle of approximately 45° relative thereto. In the preferred embodiment of the invention, a separate weir is mounted to the drip edge of the roof in alignment with each cross member of the rain disperser assembly.

As an alternative to the embodiments discussed above, a plurality of diversion elements may be mounted to, or integrally defined on, a single supporting structure such as a longitudinally extending plate or sheet. The diversion elements are spaced a predetermined distance apart from each other corresponding to the spacing of the cross-members of a roof water dispersal assembly mounted below. The supporting structure is mounted to the drip edge of the roof so that the diversion elements are aligned with the cross-members of the dispersal assembly to divert the flow of roof water away from the cross-members. Preferably, the supporting element will be a known roof drip edge extender (i.e.—a plate having a downwardly sloped forward edge which is mounted to the drip edge of a roof to outwardly extend the drip edge for controlling or varying the position at which roof water impacts against a dispersal assembly mounted therebelow) having cut-out, upturned front edge portions defining the diversion elements. Roof water diverted around the upturned edge portions flows downwardly along the sloped edge portions laterally disposed between the up-turned edge portions and is directed onto specific locations of the dispersal assembly therebelow. The use of a drip edge extender which integrally defines diversion elements thereon enables control of the flow of roof water in both a lateral direction (as a result of the diversion elements) and in a forward direction outward from the roof (as a result of the extension of the drip edge) to provide more precise control over the specific area of the dispersal assembly impacted by the roof water.

Figure 9:
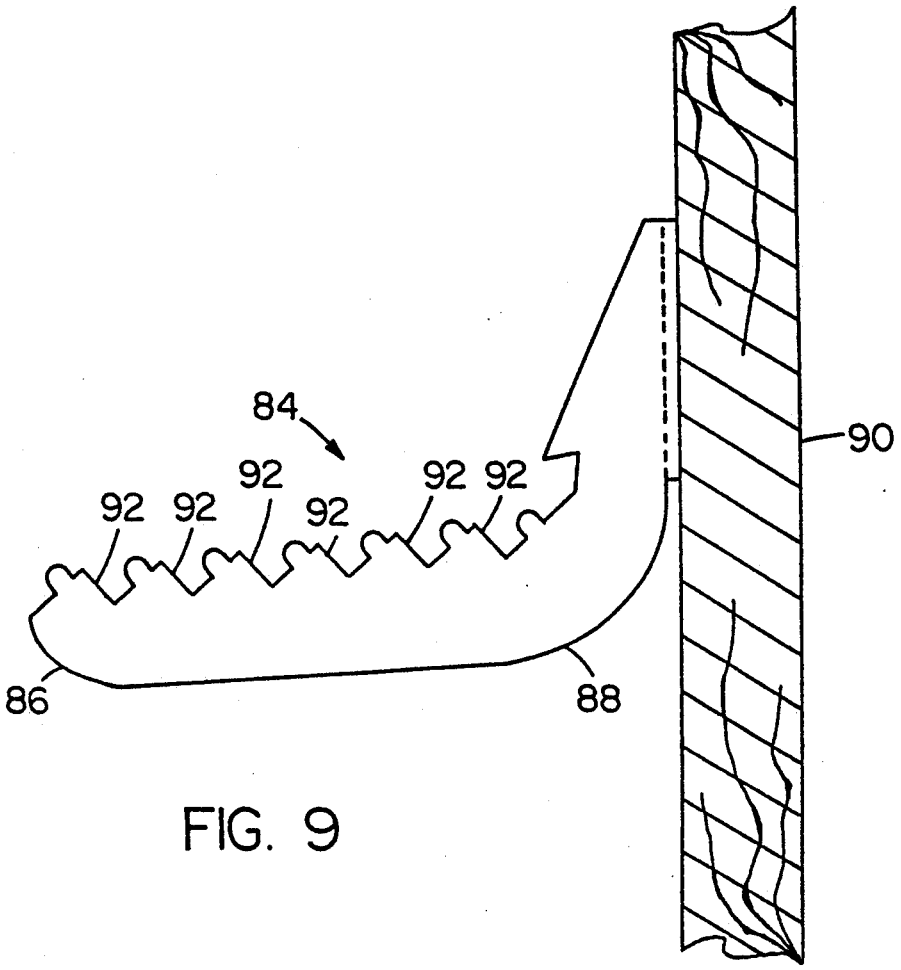
FIG. 9 illustrates a side elevational view of a bracket/spacer element combination in accordance with the present invention mounted to a vertical wall of a building structure.

FIG. 9 of the drawing illustrates a further manner for reducing the undesirable effect of roof run-off water impacting against cross members of the rain dispersal system. The drawing figure illustrates a cross member generally designated by reference numeral 84, which is both a supporting bracket and transverse spacer element for a rain dispersal system in accordance with the present invention. The cross member 84 includes forward and rear rounded corners 86 and 88, similar to that disclosed by the improved bracket 58 shown in FIG. 7. Similarly, the cross member 84 is downwardly sloped in a direction outwardly from vertically oriented fascia board 90 to which the cross member is mounted. The top surface of cross member 84 includes a plurality of projections 92 for receiving a plurality of longitudinally extending roof water disperser elements, in a manner similar to the spacer elements described and illustrated in U.S. Pat. No. 4,646,488, previously discussed herein.

The cross member 84 provides a dual function in which it acts both as a transverse spacer member for the longitudinally extending roof water dispersal elements, and further provides the mounting means for the assembled roof water disperser system to a building structure. By employing a single element to perform both of these functions, the number of cross members of an assembled rain disperser unit is reduced. This reduces the quantity of roof run-off water which will impact against the cross members to reduce the adverse and undesirable effect of such impacts. Element 84 of FIG. 9 can be used in combination with the diversion element of FIG. 8 to both reduce the number of transverse cross members in the rain disperser assembly, and to also divert roof run-off water around the remaining transverse cross members.

The embodiments of the invention described herein provide an improved rain disperser system overcoming several known disadvantages of the aforementioned prior art systems. Systems in accordance with the embodiments of the invention described herein improve the overall dispersion characteristic and efficiency of rain disperser systems but retain the necessary structural integrity for proper operation. Other variations and modifications within the scope of the invention will be apparent to those skilled in the art. Accordingly, the description of the preferred embodiments herein is illustrative only, and is not intended to limit the scope of the invention, that scope being defined by the following claims and all equivalents thereto.

We claim:

1. A roof water dispersal assembly comprising a plurality of longitudinally extending dispersal elements oriented substantially parallel to a drip edge of a roof structure, and means for mounting said plurality of dispersal elements relative to said drip edge of said roof to receive and disperse water flowing from said roof, at least one of said dispersal elements having a cross sectional configuration comprising first and second portions, said first portion being supported by said means for mounting, said second portion extending at an angle from said first portion, said at least one dispersal element being mounted in said assembly such that the angular orientation between said second extended portion and a substantially vertical plane extending substantially perpendicular to said drip edge of said roof is an angle other than zero degrees.

2. The assembly as claimed in claim 1 wherein said first portion of said at least one dispersal element is flat.

3. The assembly as claimed in claim 1 wherein said first portion of said at least one dispersal element is curved.

4. The assembly as claimed in claim 1 in which said first portion of said at least one dispersal element is longer than said second portion of said at least one dispersal element.

5. The assembly as claimed in claim 1 in which said angular orientation of said second portion of said at least one dispersal element relative to said vertical plane is greater than zero degrees or less than or equal to 70 degrees and said second portion extends in a direction away from said drip edge of said roof.

6. The assembly as claimed in claim 1 in which said angular orientation of said second portion of said at least one dispersal element is greater than zero degrees and less than or equal to 70 degrees and said second portion extends in a direction towards said drip edge of said roof.

7. The assembly as claimed in claim 1 in which said angular orientation of said second portion of said at least one dispersal element is substantially 30 degrees relative to said vertical plane and said second portion extends in a direction away from said drip edge of said roof.

8. The assembly as claimed in claim 1 further including at least two opposed edge members, said at least one dispersal element being disposed between said opposed edge members.

9. The assembly as claimed in claim 8 wherein said at least one dispersal element disposed between said opposed edge members includes said flat first portion, and another of said at least one dispersal elements disposed between said opposed edge members includes said curved first portion.

10. The assembly as claimed in claim 8 further including a plurality of dispersal elements disposed between said opposed edge members, at least one of said dispersal elements being of a cross sectional thickness which is different from the cross sectional thickness of at least another of said dispersal elements disposed between said opposed edge members.

* * * * *